US010319333B2

(12) United States Patent
Tripathi

(10) Patent No.: US 10,319,333 B2
(45) Date of Patent: Jun. 11, 2019

(54) REFRESH RATE MATCHING FOR DISPLAYS

(71) Applicant: Apple Inc., Cupertino, CA (US)

(72) Inventor: Brijesh Tripathi, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 940 days.

(21) Appl. No.: 13/627,885

(22) Filed: Sep. 26, 2012

(65) Prior Publication Data

US 2014/0085275 A1 Mar. 27, 2014

(51) Int. Cl.
*G09G 5/00* (2006.01)

(52) U.S. Cl.
CPC ..... *G09G 5/005* (2013.01); *G09G 2310/0232* (2013.01); *G09G 2340/02* (2013.01); *G09G 2340/0435* (2013.01); *G09G 2360/121* (2013.01)

(58) Field of Classification Search
CPC ..... G09G 5/005; G09G 2340/0435; G09G 2360/121; G09G 2340/02; G09G 2310/0232
See application file for complete search history.

(56) References Cited

U.S. PATENT DOCUMENTS 6,054,980 A 4/2000 Eglit
7,388,618 B2 6/2008 Tardif
7,430,018 B1 * 9/2008 Patel ..... 348/588
7,948,556 B2 5/2011 Kumakawa
8,179,388 B2 5/2012 Wyatt et al.
8,542,221 B1 * 9/2013 Wyatt ..... G06F 15/00 345/204
2002/0186213 A1 * 12/2002 Koizumi ..... G06F 3/147 345/208
2008/0055342 A1 * 3/2008 Liao ..... G09G 3/3611 345/698
2008/0143729 A1 * 6/2008 Wyatt et al. ..... 345/501
2009/0327777 A1 * 12/2009 Vasquez ..... G09G 3/3611 713/320
2010/0149413 A1 * 6/2010 Kumakawa ..... 348/447
2012/0075334 A1 * 3/2012 Pourbigharaz et al. ..... 345/619
2012/0083320 A1 * 4/2012 Hijazi et al. ..... 455/566
2013/0141642 A1 * 6/2013 Wu ..... G06F 3/1407 348/441
2013/0163876 A1 * 6/2013 Silver et al. ..... 382/190

* cited by examiner

*Primary Examiner* — Aneeta Yodichkas
(74) *Attorney, Agent, or Firm* — Meyertons, Hood, Kivlin, Kowert & Goetzel, P.C.; Lawrence J. Merkel

(57) ABSTRACT

In a graphics system, pixels may be provided to a graphics display at a pixel clock rate corresponding to an actual refresh rate nearest to and lower than a desired/target refresh rate. A number of additional pixels may be provided with the pixels for each image frame. The number is based at least on the actual refresh rate, target refresh rate, and a pixel-resolution of the image frame, such that providing pixels of an image frame and the number of additional pixels for each image frame at the pixel clock rate results in an effective refresh rate matching the target refresh rate. The additional pixels may be provided by adding one or more pixels at the end of each horizontal line of the image frame, or by adding an extra partial line in the vertical blanking interval. The additional pixels are not displayed and do not adversely affect normal operation.

22 Claims, 5 Drawing Sheets

REFRESH RATE MATCHING FOR DISPLAYS

BACKGROUND

Field of the Invention

This invention is related to the field of graphical information processing, more particularly, to refresh rate matching for graphics displays.

Description of the Related Art

Part of the operation of many computer systems, including portable digital devices such as mobile phones, notebook computers and the like is the use of some type of display device, such as a liquid crystal display (LCD), organic light emitting diode (OLED) display, or plasma display, to display images, video information/streams, and data. Accordingly, these systems typically incorporate functionality for generating images and data, including graphics and video information, which are subsequently output to the display device. Such devices typically include video graphics circuitry to process images and video information for subsequent display.

In digital imaging, the smallest item of information in an image is called a "picture element", more generally referred to as a "pixel". For convenience, pixels are generally arranged in a regular two-dimensional grid. By using this arrangement, many common operations can be implemented by uniformly applying the same operation to each pixel independently. Since each pixel is an elemental part of a digital image, a greater number of pixels can provide a more accurate representation of the digital image. The intensity of each pixel can vary, and in color systems each pixel has typically three or four components such as red, green, blue, and black.

Most images and video information displayed on display devices such as LCD screens are interpreted as a succession of image frames, or frames for short. While generally a frame is one of the many still images that make up a complete moving picture or video stream, a frame can also be interpreted more broadly as simply a still image displayed on a digital (discrete, or progressive scan) display. A frame is typically composed of a specified number of pixels according to the resolution of the image/video frame. Information associated with a frame typically consists of color values for every pixel to be displayed on the screen. Color values are commonly stored in 1-bit monochrome, 4-bit palletized, 8-bit palletized, 16-bit high color and 24-bit true color formats. An additional alpha channel is oftentimes used to retain information about pixel transparency. The color values can represent information corresponding to any one of a number of color spaces.

Systems that feature a display device, such as an LCD screen or other type of display, also typically feature a Display Controller to control the timing of the signals, including video synchronization signals that are provided—from a graphics-processing unit, for example—to be displayed. Some Display Controllers are divided into multiple functional stages, for example an interface to receive the pixels from the source (e.g. from the graphics processing unit), and a port control unit to provide the appropriate signals to a display port physically coupling to the display. In some cases, additional functional or logic blocks are instantiated within the Display Controller between the interface and the port control unit. It is important for all components, including the additional functional/logic blocks within the Display Controller to communicate seamlessly and efficiently with each other.

One functionality related to the interoperability of the display controller and the display is the display panel's refresh rate (most commonly the "vertical refresh rate"), which refers to the frequency at which the display hardware draws the graphics data. The display refresh rate is distinct from the frame rate at which image frames may be delivered to the display. A given refresh rate may result in the repeated display of identical frames, while the frame rate is indicative of the frequency at which entire frames of new data are sent to the display. For example, the refresh rate or temporal resolution of an LCD display is indicative of the number of times per second that the LCD display draws the data provided to it. Because (most) progressive scan displays do not turn activated pixels on/off between frames, such displays exhibit no refresh-induced flicker, no matter how low their refresh rate is. Typically the closest equivalent to a refresh rate on an LCD monitor is its frame rate, which is often locked at 60 frames/s. For this reason many present day systems are required to implement a refresh rate that is exactly 60 Hz. However, depending on the display resolution parameters and available options for pixel clock rate of a given design, the acceptable pixel clock rates may be very limited or even impossible to find, which may also prevent the implementation of an exact refresh rate of 60 Hz.

Other corresponding issues related to the prior art will become apparent to one skilled in the art after comparing such prior art with the present invention as described herein.

SUMMARY

In a graphics system, it may not be possible to implement a pixel clock rate that exactly corresponds to the target refresh rate of a graphics display intended to display the generated image frames, which may be still frames or video frames or overlay graphics frames and the like. However, a method may be employed to match the target refresh rate while providing pixels to the graphics display at the implemented pixel clock rate. The pixel clock rate that can be implemented may be selected to correspond to an effective refresh rate that is nearest to the target refresh rate (e.g. to 60 Hz) while also being lower than the target refresh rate. A calculation, based on at least the effective refresh rate, the target refresh rate, and the pixel resolution of the image frame, may be performed to determine the total number of pixels that would have to be provided at the implemented pixel clock rate to match the target refresh rate for each frame. Accordingly, a number of additional pixels required for each frame may be determined based on the calculated total number of pixels and the number of pixels present in each frame. That is, the number of additional pixels represents the number of pixels that when added to the pixels present in the image frame may result in the target refresh rate when providing all the pixels at the implemented pixel clock rate.

The additional pixels may be implemented as "dummy pixels", or blank pixels that can be included in the blanking portion of the frame. In one set of embodiments, one or more individual pixels can be added at the end of one or more horizontal lines, as required, to bring the total number of pixels to the desired number. These pixels may simply be detected as errors by the display panel (or graphics display) used to display the image frames, and may therefore not affect operation. In another set of embodiments, the additional pixels may be added to the end of the frame in the vertical blanking interval, in which case the vertical blanking interval may simply appear to be slightly longer than expected, again not affection normal operation.

BRIEF DESCRIPTION OF THE DRAWINGS

The following detailed description makes reference to the accompanying drawings, which are now briefly described.

Figure 1:
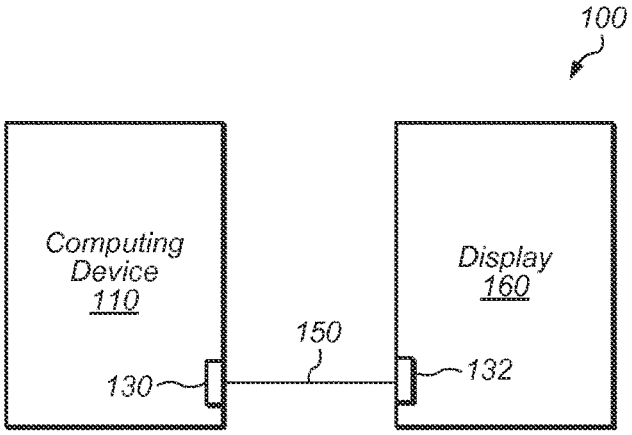
FIG. 1 shows a partial block diagram of one embodiment of a computer system that includes a computing device driving a graphics display.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. § 112, paragraph six interpretation for that unit/circuit/component.

DETAILED DESCRIPTION OF EMBODIMENTS

FIG. 1 shows a block diagram of one embodiment of a computer system in which a computing device provides pixels for displaying on a display. Computer system 100 includes computing device 110, which may be any suitable type of computing device. In one embodiment, device 110 is a tablet computing device such as an iPad™ product.

As shown in FIG. 1, device 110 is coupled to display (panel) 160 via display port connection 150. As used herein, a display, display panel, or graphics display refers to any device that is configured to present a visual image in response to control signals to the display. A variety of technologies may be used in the display, such as cathode ray tube (CRT), thin film transistor (TFT), liquid crystal display (LCD), light emitting diode (LED), plasma, etc. A display may also include touch screen input functionality, in some embodiments. The display devices may also be referred to as panels, in some cases.

Computing device 110 includes an external interface 130 to couple to external display 160 via connection 150. Similarly, display 160 may contain a panel driver interface 132 to receive the information from computing device 110 for displaying on display panel 160. Interface 130 may be any type of standard or proprietary interface, and may be wired or wireless. A given interface 130 can be understood to have a "data width" (e.g., a number of pins) dedicated to a specified amount of data the interface can transfer at a given point in time. Specifically, interface 130 may have a specified number of lines dedicated to transferring graphics (e.g. video/image) information to external display 160. Interface 130 may also be configured to provide data to other types of external devices that may also be coupled to computing device 110 via interface 130, in lieu of or in addition to external display 160. Connection 150 is a logical representation of the connection between device 110 and display 160. In various embodiments, connection 150 may be wireless. In other embodiments, connection 150 may be wired, and may include one or more intervening hardware components, such as a scaling unit or timing controller chip. In one embodiment, display 160 is a high-definition TV (HDTV) compatible device.

Computing device 110 may include various structures (not depicted in FIG. 1) that are common to many computing devices. These structures include one or more processors, memories, graphics circuitry, I/O devices, bus controllers, etc. Processors within device 110 may implement any instruction set architecture, and may be configured to execute instructions defined in that instruction set architecture. The processors may employ any microarchitecture, including scalar, superscalar, pipelined, superpipelined, out of order, in order, speculative, non-speculative, etc., or combinations thereof. The processors may include circuitry, and optionally may implement microcoding techniques. The processors may include one or more L1 caches, as well one or more additional levels of cache between the processors and one or more memory controllers. Other embodiments may include multiple levels of caches in the processors, and still other embodiments may not include any caches between the processors and the memory controllers.

Memory controllers within device 110 may comprise any circuitry configured to interface to the various memory requestors (e.g. processors, graphics circuitry, etc.). Any sort of interconnect may be supported for such memory controllers. For example, a shared bus (or buses) may be used, or point-to-point interconnects may be used. Hierarchical connection of local interconnects to a global interconnect to the memory controller may be used. In one implementation, a memory controller may be multi-ported, with processors having a dedicated port, graphics circuitry having another dedicated port, etc.

Alternatively, the devices may be mounted with a system on a chip in a chip-on-chip configuration, a package-on-package configuration, or a multi-chip module configuration. Graphics controllers within device 110 may be configured to render objects to be displayed into a frame buffer in the memory. The graphics controller may include one or more graphics processors that may execute graphics software to perform a part or all of the graphics operation, and/or hardware acceleration of certain graphics operations. The amount of hardware acceleration and software implementation may vary from embodiment to embodiment.

Figure 2:
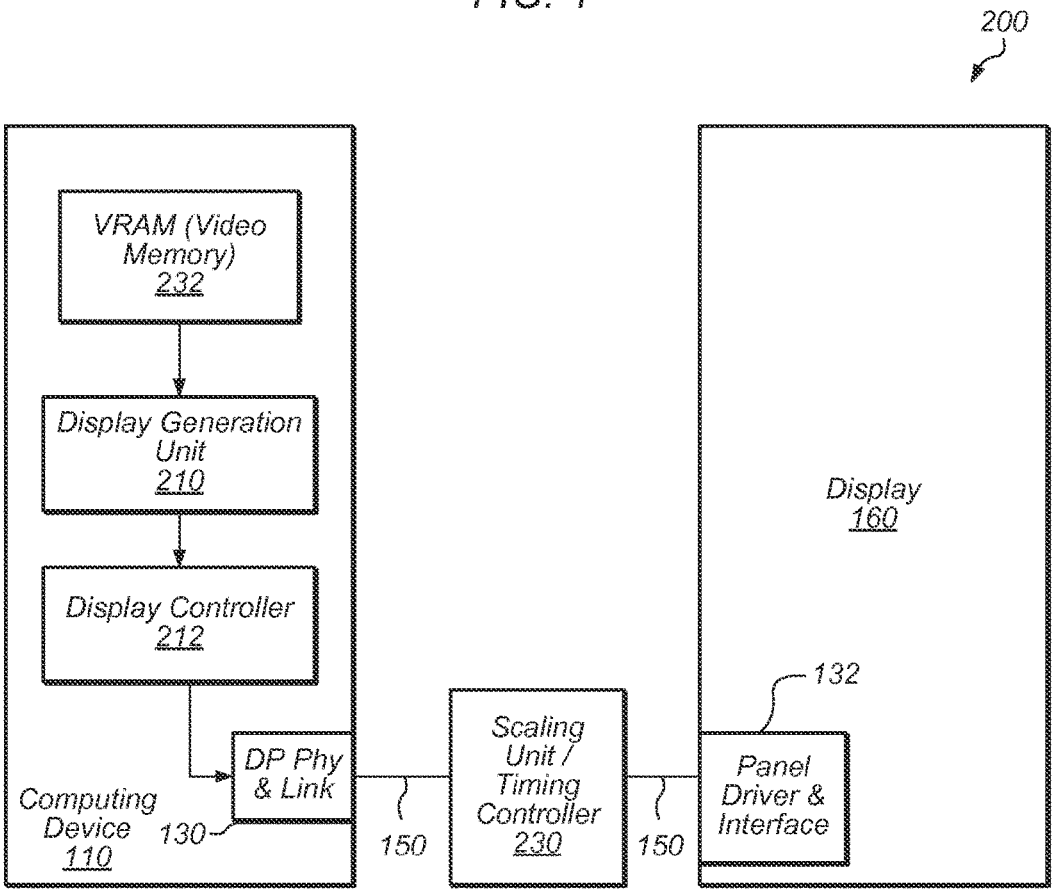
FIG. 2 shows a more detailed partial block diagram of one embodiment of a computer system that includes a computing device driving a graphics display through a scaling unit/timing controller.

Referring now to FIG. 2, a more detailed partial block diagram of the system of FIG. 1 is shown. In addition, system 200 also includes a scaler/timing controller unit situated in-between computing device 110 and display 160. Computing device 110 may include a display generation unit 210 which may generate the pixels to be displayed on display 160. Display generation unit 210 may receive video and/or image information from memory elements 232, which store the video frames/information and image frame information, to provide that information (e.g. pixels) to display generation unit 210 as required. Memory 232 may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMM5), etc.

In some embodiments, the video frames/information may be represented in a first color space, according the origin of the video information. For example, the video information may be represented in the YCbCr color space. At the same time, the image frame information may be represented in the same color space, or in another, second color space, according to the preferred operating mode of the graphics processors. For example, the image frame information may be represented in the RGB color space. Display generation unit 210 may include components that blend the processed image frame information and processed video image information to generate output frames that may be stored in a buffer, from which they may be provided to a display controller 212, which may provide the output pixel stream to display port (physical layer and link) 130 to be sent out over connection 150.

In one set of embodiments, the output frames may be presented to the display controller 212 through an asynchronous FIFO (First-In-First-Out) buffer in display generation unit 210. The display controller may control the timing of the display through a Vertical Blanking Interval (VBI) signal that may be activated at the beginning of each vertical blanking interval. This signal may cause the graphics processor(s) to initialize (Restart) and start (Go) the processing for a frame (more specifically, for the pixels within the frame). Between initializing and starting, configuration parameters unique to that frame may be modified. Any parameters not modified may retain their value from the previous frame. As the pixels are processed and put into the output FIFO, the display controller may issue signals (referred to as pop signals) to remove the pixels at the display controller's clock frequency. The pixels thus obtained may be queued up in the output FIFO at the clock rate of the processing elements within display generation unit 210, and fetched by the display controller at the display controller's clock rate.

Computing device 110 may operate to display frames of data. Generally, a frame is data describing an image to be displayed. As mentioned above, a frame may include pixel data describing the pixels included in the frame (e.g. in terms of various color spaces, such as RGB or YCbCr), and may also include metadata such as an alpha value for blending. Static frames may be frames that are not part of a video sequence. Alternatively, video frames may be frames in a video sequence. Each frame in the video sequence may be displayed after the preceding frame, at a rate specified for the video sequence (e.g. 15-30 frames a second). Video frames may also be complete images, or may be compressed images that refer to other images in the sequence. If the frames are compressed, a video pipeline in device 110 may decompress the frames.

The display generation unit 210 may be configured to read frame data from memory 232 and to process the frame data to provide a stream of pixel values for display. Generally, a pixel value in a stream of pixel values may be a representation of a pixel to be displayed on a display coupled to device 110, such as display 160. The pixel stream may be a series of rows of pixels, each row forming a line on the display screen. In a progressive-mode display, the lines are drawn in consecutive order and thus the next line in the pixel stream is immediately adjacent to the previous line. In an interlaced-mode display, consecutive passes over the display draw either the even or the odd lines, and thus the next line in the pixel stream skips one line from the previous line in the pixel stream. For brevity, the stream of pixel values may be referred to as a pixel stream, or a stream of pixels. Display generation unit 210 within device 110 may perform various pixel operations on the pixel stream, and eventually provide the processed pixel stream to the display port physical layer and link (DP Phy & Link) 130 via display controller 212, as mentioned above.

Oftentimes, the resolution (i.e., the number of pixels in the horizontal and vertical directions) of the image frame generated by unit 210 is different from the resolution of display 160. In order to facilitate display of images on such a display, the data sent to panel driver 132 may be downscaled/compressed. The compression means loss of image resolution, requiring a retiming of the frames before they are transmitted to panel driver 132. Thus, some embodiments may include a scaling unit/timing controller 230 that may be used to scale and retime the frames before they reach panel driver 132. It should be noted also, with reference to both FIGS. 1 and 2, that computer system 100 and computer system 200 may be designed as a single-box system in which computing device 110 and panel display 132 are a single unit, e.g. a laptop computer, or computing device 110 and panel display 132 may represent individual devices. Furthermore, in the latter case, computing device 100 may itself include an internal display as well, which may be controlled in a manner similar to what is described herein. Overall, the various separate elements in FIGS. 1 and 2 are shown for highlighting their respective functionalities as operated within the disclosed embodiments.

Figure 3:
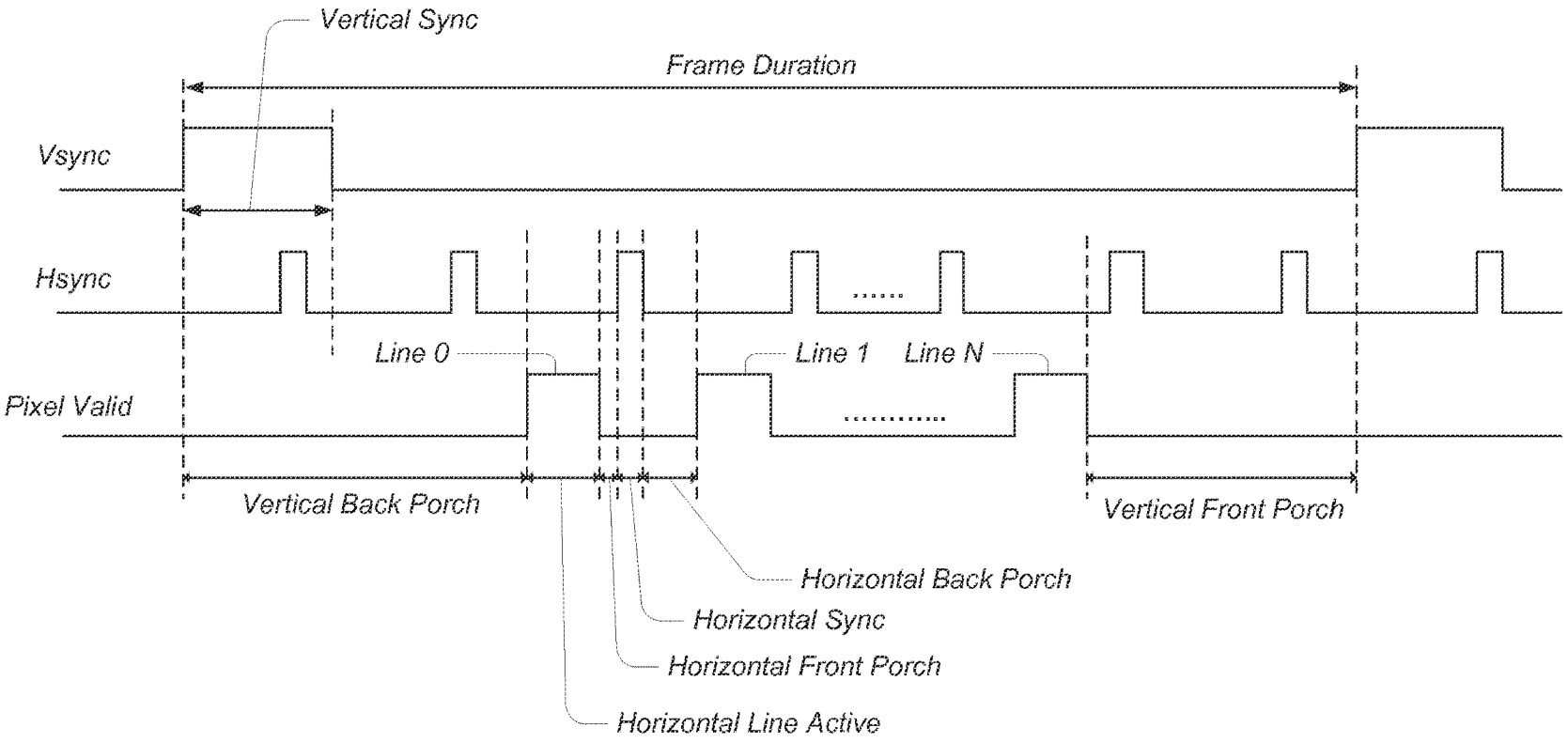
FIG. 3 shows a timing diagram illustrating the relationship between various timing signals when outputting an image frame.

FIG. 3 shows the relationship between the important timing signals when outputting a frame composed of N lines.

As seen in FIG. 3, a Vertical Sync signal Vsync indicates the boundary between two image frames, that is, between two respective pixel streams representative of two corresponding image frames. Since the image frame is composed of image lines, specifically N image lines, timing signals are also generated to properly identify and separate the different image lines in the frame. Accordingly, following a 'Vertical Back Porch' time period (that is, a time period of specified length labeled 'Vertical Back Porch'), a horizontal synchronization (or sync) pulse Hsync ('Horizontal Sync') is asserted after a 'Horizontal Front Porch' time interval that follows the last pixel data in the previous line. Hsync is deasserted following the Hsync duration, as shown. A specified time interval labeled 'Horizontal Back Porch' is observed between the deassertion of the Hsync signal and the start of new pixel data for the next line. The vertical synchronization signal Vsync is asserted after a specified 'Vertical Front Porch' time interval following the last pixel data in the last line of a frame. The "Horizontal Line Active" time interval represents the specified time interval during which pixel data for the given line is transmitted, and includes the horizontal blanking period.

Referring to system 100 in FIG. 1 and/or system 200 in FIG. 2, systems 100 and 200 may be required to implement exactly a 60 Hz refresh rate. That is, system 200 may have to be designed such that display controller 212 provides the pixel stream to display 160 at a pixel clock rate that effectively results in (or corresponds to) a refresh rate of 60 Hz. However, depending on the display resolution parameters and the maximum clock rate of the design, the acceptable pixel clock rates may be very limited or even impossible to find. That is, there might be no way to implement a pixel clock rate in display controller 212 that would yield a refresh rate of 60 Hz. To overcome this potential issue, a method may be devised to match an implemented refresh rate (i.e. an implemented pixel clock rate) that is different from 60 Hz.

A pixel clock rate that can be implemented and provides a refresh rate that is nearest to 60 Hz (but less than 60 Hz) may be selected/specified. The number of additional pixels that would be required in one image frame to yield exactly 60 Hz can then be calculated, and these pixels (referred to as dummy pixels) may be included in the blanking portion of the frame. In one set of embodiments, individual pixels may be added at the end of each horizontal line. These pixels may simply be detected as errors by the display panel (e.g. display panel 160), and may therefore not affect operation. In another embodiment, the pixels may be added to the end of the frame, in the vertical blanking interval. The result of adding the pixels to the end of the frame may be the appearance of a slightly longer than expected vertical blanking interval.

Figure 4:
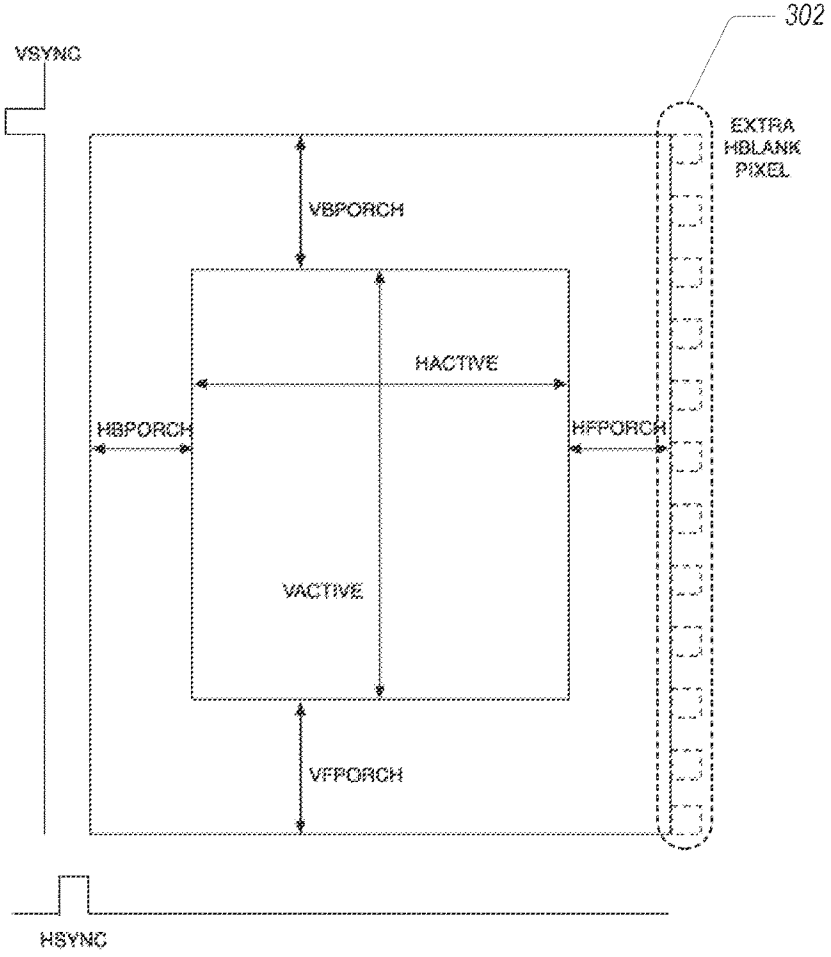
FIG. 4 shows a composite timing diagram with horizontal sync and vertical sync when adding extra horizontal blank pixels to an image frame.

The concept of adding dummy pixel(s) at the end of each horizontal line of the image frame is illustrated in FIG. 4, which shows a composite timing/frame diagram illustrating the relationship of a single image frame to the horizontal sync signal (HSYNC) and vertical sync signal (VSYNC), and various other representative control signals corresponding to the frame timing control signals shown in the timing diagram of FIG. 3. As seen in FIG. 4, the beginning of the frame is indicated by the VSYNC pulse, and the beginning of each line is indicated by the HSYNC pulse. The respective horizontal and vertical porch signals (horizontal back porch, horizontal front porch, vertical back porch, vertical front porch) all correspond to the respective signals of the same name shown in FIG. 3. The HACTIVE signal is indicative of active horizontal line pixels within the given frame, while the VACTIVE signal is indicative of active pixels within the given frame.

As illustrated in FIG. 4, extra horizontal blank (dummy) pixel(s) may be added at the end of horizontal lines, in order to produce an effective frame rate that yields a desired refresh rate. For example, the refresh rate of the display (e.g. display 160) may be 60 Hz, but due to various system considerations, such as overall resolution, display resolution parameters, maximum clock rate of the system (e.g. system 100 and/or system 200), etc., the implemented pixel clock rate at which the pixels are being provided (e.g. by display controller 212) yields, or corresponds to, an effective refresh rate of, 59 Hz, for example. 59 Hz, in this scenario, may represent the refresh rate closest to 60 Hz and also lower than 60 Hz for which a corresponding pixel clock rate can be implemented. Based on various factors, e.g. resolution, the number of additional pixels required in each frame to yield a refresh rate of 60 Hz may be determined, and those pixels added to the frame at the end of one or more horizontal lines as represented in FIG. 4 by dummy pixels 302.

Figure 5:
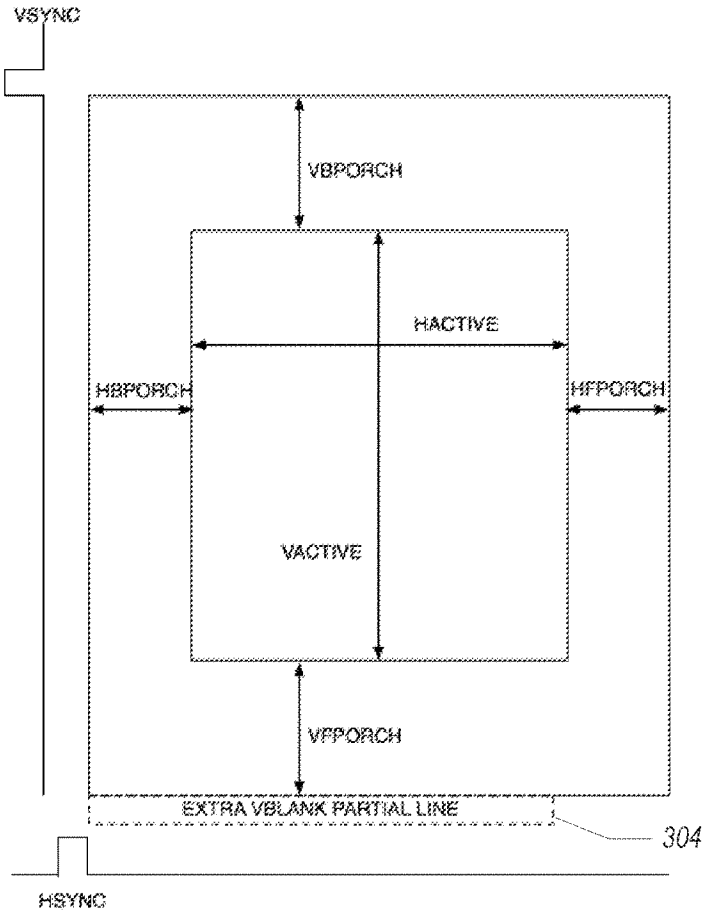
FIG. 5 shows a shows a composite timing diagram with horizontal sync and vertical sync when adding an extra vertical blank partial line to an image frame.

The concept of adding dummy pixel(s) at the end of the image frame is illustrated in FIG. 5, which again shows a composite timing/frame diagram illustrating the relationship of a single image frame to the horizontal sync signal and vertical sync signal, and various other representative control signals corresponding to the frame timing control signals shown in the timing diagram of FIG. 3. Similar to FIG. 4, the beginning of the frame is indicated by the VSYNC pulse, and the beginning of each line is indicated by the HSYNC pulse. The respective horizontal and vertical porch signals (horizontal back porch, horizontal front porch, vertical back porch, vertical front porch) again all correspond to the respective signals of the same name shown in FIG. 3. The HACTIVE signal is indicative of active horizontal line pixels within the given frame, while the VACTIVE signal is indicative of active pixels within the given frame. The conditions may be similar to those described for the example provided in connection with FIG. 4, except in this case the additional pixels are added at the end of the frame in the vertical blanking interval as extra vertical blank partial line 304.

As shown above, a desired refresh rate may therefore be matched by implementing a pixel clock rate that does not directly yield the desired refresh rate. The pixel clock rate (or frequency) may be selected to result in (or yield) a refresh rate nearest to the desired refresh rate, with the nearest refresh rate also being lower than the desired refresh rate. Subsequently, a specified number of additional pixels may be added in each image frame to cause an achieved refresh rate that matches the desired refresh rate. The additional pixels may be distributed in the image frame by adding an extra blank (or dummy pixel) at the end of one or more horizontal lines of the frame, which may simply lead to the display interpreting the blank pixels as errors, thereby ignoring those pixels and not affecting proper operation. Alternatively, the blank pixels may be added together at the end of the frame, in the vertical blanking interval, as an extra blank (partial) line, which may result in the appearance of a slightly longer than expected vertical blanking interval, also without affecting proper operation.

Figure 6:
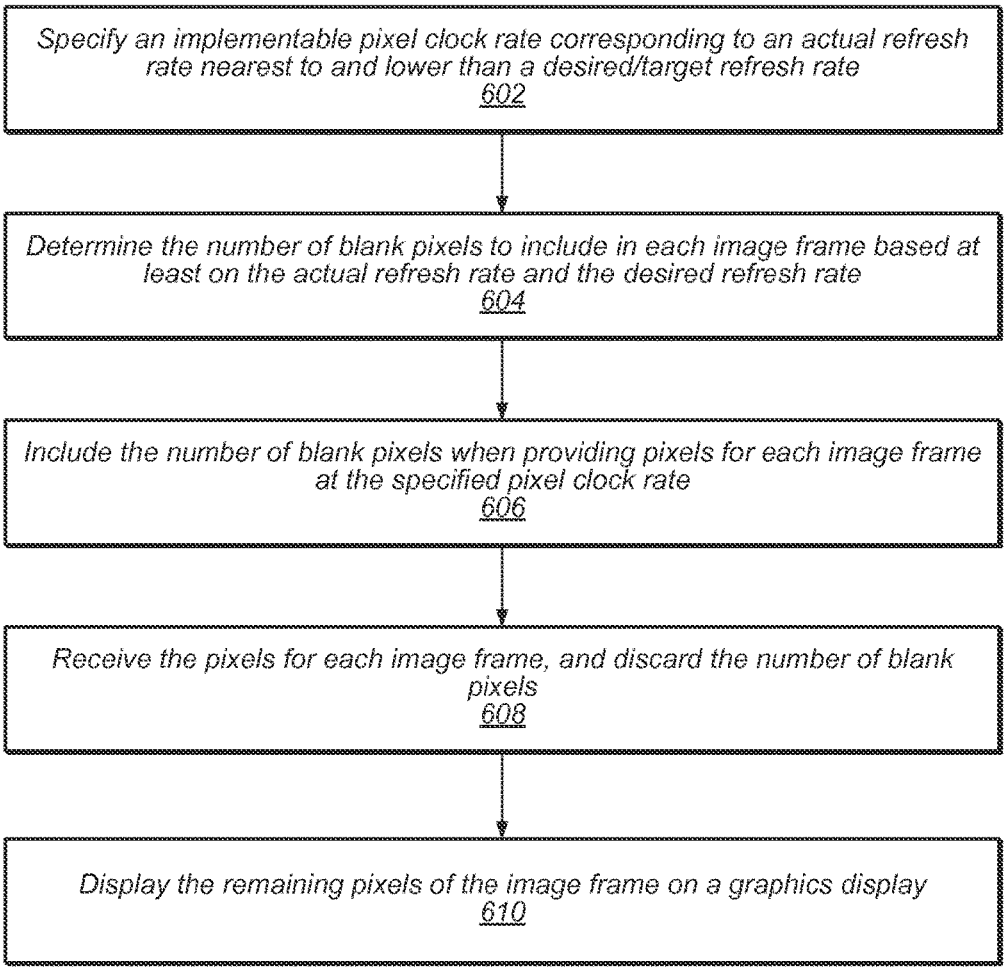
FIG. 6 shows a flow diagram illustrating one embodiment of a method for matching a refresh rate for a graphics display.

FIG. 6 shows a flow diagram of one embodiment of a method to match the refresh rate of a display when a pixel clock rate at which pixels are provided to the graphics display cannot be implemented to correspond exactly to the refresh rate of the display. As shown in 602, an implementable pixel clock rate may be specified such that the implementable pixel clock rate corresponds to an actual refresh rate nearest to and lower than a desired (or target) refresh rate, e.g. the refresh rate of a display for which the pixels are intended. In 604, the number (N) of blank pixels to include in each image frame is determined based at least on the actual refresh rate and the desired refresh rate. Subsequently, when providing pixels for each image frame at the specified pixel clock rate, the blank pixels are included, as indicated in 606. That is, for each frame, N blank pixels are also provided with the pixels of that image frame. The pixels for each image frame are received, and the blank pixels are discarded, as indicated in 608. Finally, as shown in 610, the remaining pixels of the image frame are displayed on a graphics display. Referring again to exemplary system 200, it should be noted that the insertion of blank pixels may be performed in a variety of ways, and may be accomplished in, for example, display generation unit 210, or in display controller 212. Overall, display controller may provide the pixels at the actual implemented pixel clock rate corresponding to the actual refresh rate, with the addition of the blank pixels causing a matching of the desired refresh rate, which may be the actual operating refresh rate of display 160 (for example).

Figure 7:
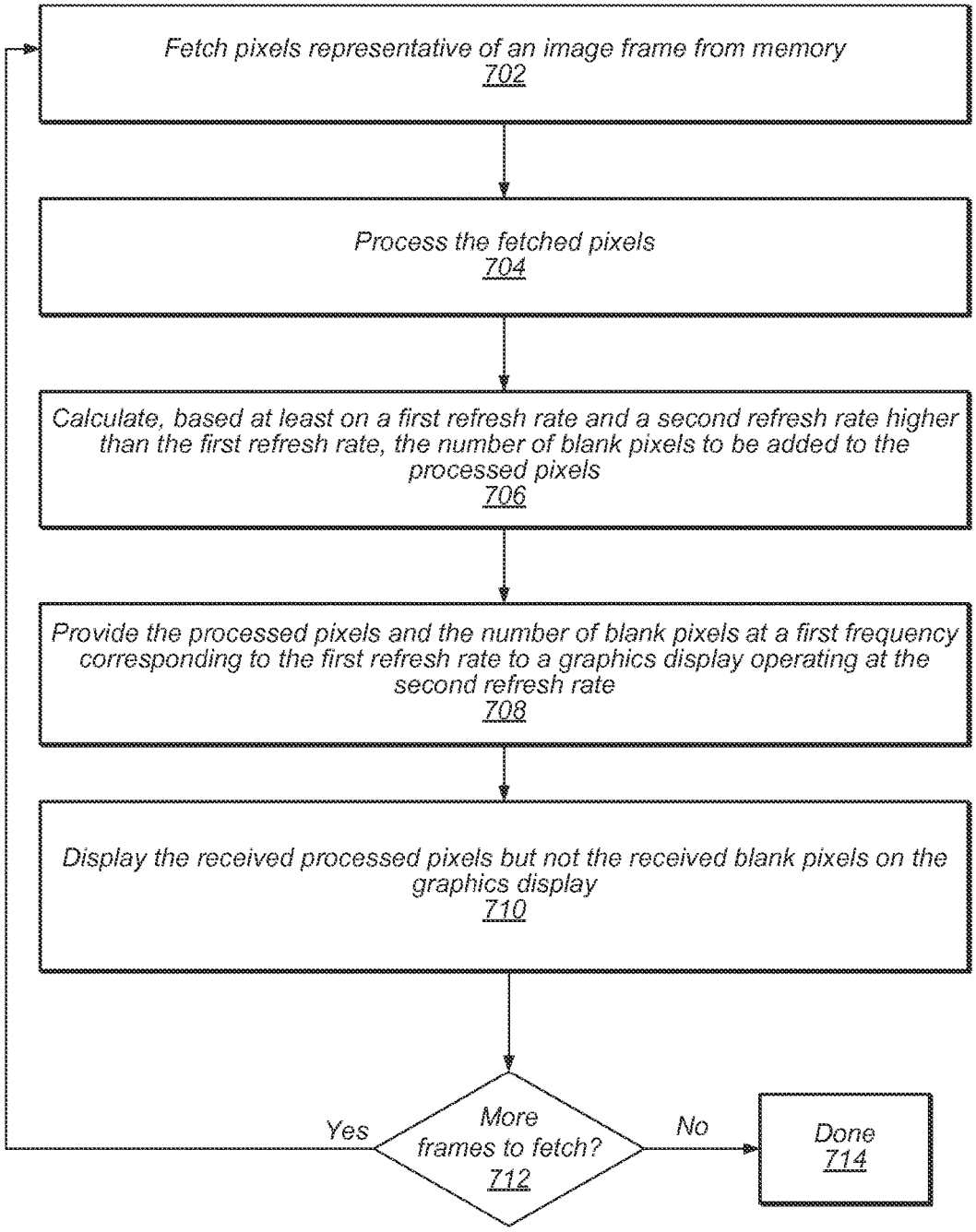
FIG. 7 shows a flow diagram illustrating an alternate embodiment of a method for matching a refresh rate for a graphics display.

FIG. 7 shows a flow diagram of a method of processing and displaying image frames while matching the refresh rate of the graphics display on which the image frames are displayed, when a pixel clock rate at which the pixels are provided to the graphics display cannot be implemented to correspond exactly to the refresh rate of the graphics display. As indicated in 702, pixels representative of an image frame are fetched from memory, e.g. VRAM 232 shown in FIG. 2. As indicated in 704, the fetched pixels may then be processed, for example in display generation unit 210 shown in FIG. 2. Additionally, as indicated in 706, a calculation may be performed, based at least on a first refresh rate and a second refresh rate higher than the first refresh rate, to obtain a number of blank pixels to be added to the processed pixels. In reference to system 200, the calculation may be performed in any suitable component of computing device 110, and may also take into account the resolution of the image frame and any other factors that may affect the rate at which pixels are to be provided to the graphics display. Furthermore, the calculation may be performed at any time the required information to perform the calculation is known. In other words, the diagram in FIG. 7 (and also in FIG. 6) is not intended to indicate a chronological ordering of when the calculation or determination of the number of blank pixels is made.

As shown in 708, the processed pixels and the number of blank pixels are provided at a first frequency representative of the first refresh rate to a graphics display operating at the second refresh rate. As also mentioned previously, in one set of embodiments, the blank pixels may be distributed to have one (or more, if necessary) pixel(s) provided at the end of a number (or all) horizontal lines of the image frame. In those embodiments, the blank pixels may simply be interpreted by the graphics display as errors, and be safely discarded without affecting normal operation. In alternate embodiments, the blank pixels may be added together at the end of the frame in the vertical blanking interval as an extra vertical blank partial line. In those embodiments, the vertical blank partial line may simply result in the appearance of a slightly longer than expected vertical blanking interval, also without affecting normal operation. Thus, as indicated in 710, the received processed pixels are displayed on the graphics display, while the received blank pixels are not displayed. The process may repeat for additional frames ('Yes' branch taken at 712), or if no more image frames are to be displayed, the process is complete (714).

It should also be noted (as also mentioned above) that step 706 may need to be performed only once, prior to processing and displaying the image frames. Specifically, the calculation may be performed once all the specifications required to perform the calculations in the system have been set. That is, in some embodiments, the process may begin with the calculation being performed, and fetching, processing, and displaying of the pixels may then be performed. Accordingly, in those embodiments step 706 is not part of the feedback loop shown in FIG. 7, that is, chronologically 706 may be performed first, then 702, 704, 708, and 710, in that order, with only 702, 704, 708, and 710 included in the loop with 712 looping back to 702.

Numerous variations and modifications will become apparent to those skilled in the art once the above disclosure is fully appreciated. It is intended that the following claims be interpreted to embrace all such variations and modifications.

I claim:

1. A method for matching refresh rates for a graphics display, the method comprising:

providing, by a display controller circuit, image pixel values representative of respective pixels of an image frame at an implementable pixel clock frequency that corresponds to an effective display refresh rate that is nearest to and lower than a target display refresh rate;

providing, by the display controller circuit, additional pixel values representative of a first number of additional pixels for the image frame at the implementable pixel clock frequency; and receiving, by a display driver circuit, the image pixel values and the additional pixel values for displaying the respective pixels of the image frame on the graphics display according to the target display refresh rate.

2. The method of claim 1, further comprising driving, by the display driver circuit, the graphics display operating at the target refresh rate.

3. The method of claim 2, further comprising displaying the respective pixels of the image frames on the graphics display without displaying the first number of additional pixels, responsive to the display driver circuit driving the graphics display.

4. The method of claim 1, wherein the additional pixels are blank pixels.

5. The method of claim 1, wherein the first number for the first number of additional pixels is based at least on the effective display refresh rate, the target display refresh rate, and a pixel resolution of the image frame.

6. A graphics system comprising:

a display controller configured to:

provide image pixel values representative of pixels of each image frame of one or more image frames at a pixel clock rate corresponding to an implemented refresh rate nearest to and lower than a target refresh rate; and provide additional pixel values representative of a first number of additional pixels for each image frame of the one or more image frames at the pixel clock rate, wherein providing the additional pixel values along with the image pixel values at the pixel clock rate causes a graphics display that receives the image pixel values and the additional pixel values to display the pixels of each image frame on the graphics display at the target refresh rate.

7. The graphics system of claim 6, wherein the display controller is further configured to provide the additional pixel values for each image frame by providing a respective additional pixel value representative of at least one additional respective pixel of the first number of additional pixels at a respective end of each horizontal line of pixels of one or more horizontal lines of pixels of the image frame, until all the additional pixel values for the image frame have been provided.

8. The graphics system of claim 6, wherein the display controller is further configured to provide the additional pixel values for each image frame by providing the additional pixel values during a vertical blanking interval to represent an extra vertical blank partial horizontal line of pixels.

9. The graphics system of claim 6, further comprising a graphics display operating at the target refresh rate;

wherein the display controller is further configured to provide the additional pixel values for each image frame and the image pixel values for each image frame to the graphics display.

10. The graphics system of claim 9, wherein the graphics display is configured to not display the first number of additional pixels.

11. A method for displaying image frames, the method comprising:

fetching, by a display generation circuit, pixel values representative of an image frame to be displayed;

processing, by the display generation circuit, the fetched pixel values;

providing, by a display controller circuit, a total number of pixel values for the image frame at a first clock frequency corresponding to a first refresh rate;

wherein the total number of pixel values comprises the processed pixel values and additional pixel values representative of a specified number of additional pixels, wherein the additional pixels are not part of the image frame to be displayed;

wherein providing the total number of pixel values at the first clock frequency causes a graphics display that receives the total number of pixel values to display the image frame on the graphics display at a second refresh rate higher than the first refresh rate, wherein the second refresh rate is a target display refresh rate.

12. The method of claim 11, wherein the first clock frequency is an implementable clock frequency corresponding to the first refresh rate nearest to and lower than the second refresh rate.

13. The method of claim 11, further comprising:

receiving, by a panel driver circuit, the total number of pixel values; and discarding, by the panel driver circuit, the received additional pixel values.

14. The method of claim 13, further comprising displaying pixels represented by the received processed pixel values on a graphics display.

15. The method of claim 11, wherein providing the total number of pixel values for the image frame at the first clock frequency comprises:

providing respective one or more pixel values of the additional pixel values following respective processed pixel values representative of respective last pixels of respective horizontal lines of the image frame until all of the additional pixel values have been provided.

16. The method of claim 11, wherein providing the total number of pixel values for the image frame at the first clock frequency comprises:

providing the additional pixel values during a vertical blanking interval subsequent to having provided all the processed pixel values.

17. The method of claim 11, wherein the fetching, processing, and providing is performed for a plurality of image frames.

18. A graphics system comprising:

a processing element configured to determine, based at least on a first refresh rate and a second refresh rate higher than the first refresh rate, a number of respective blank pixels for each image frame of a plurality of image frames; and circuitry configured to provide at a first pixel clock rate, for each image frame, additional pixel values representative of the number of respective blank pixels and image pixel values representative of respective pixels representative of the image frame, wherein the first pixel clock rate corresponds to the first refresh rate; and wherein providing, at the first pixel clock rate, the number of additional pixel values along with the image pixel values causes a graphics display that receives the number of additional pixel values and the image pixel values to display the respective pixels representative of the image frame on the graphics display at the second refresh rate.

19. The graphics system of claim 18, further comprising a graphics display configured to:

receive, for each image frame, the additional pixel values and the image pixel values; and for each image frame, discard the additional pixel values and display the respective pixels representative of the image frame.

20. The graphics system of claim 19, wherein to discard the additional pixel values for each image frame, the graphics display is configured to interpret each of the respective blank pixels as a pixel error.

21. The graphics system of claim 18, wherein the circuitry is further configured to provide the additional pixel values by providing at least one respective one of the additional pixel values following a respective image pixel representative of a last pixel of each respective series of pixels of a respective horizontal line of the image frame, until all of the number of respective blank pixels have been provided.

22. The graphics system of claim 18, wherein the circuitry is further configured to provide the additional pixel values by providing the additional pixel values as representing a partial line in a vertical blanking interval subsequent to having provided all the image pixel values.

* * * * *